US006677535B2

(12) United States Patent
Dlugas

(10) Patent No.: US 6,677,535 B2
(45) Date of Patent: Jan. 13, 2004

(54) ELECTRICAL CABLE

(75) Inventor: Wolfgang Dlugas, Kierspe (DE)

(73) Assignee: Eilentropp KG, Wipperfuerth (DE)

( * ) Notice: Subject to any disclaimer, the term of this patent is extended or adjusted under 35 U.S.C. 154(b) by 0 days.

(21) Appl. No.: 09/988,755

(22) Filed: Nov. 20, 2001

(65) Prior Publication Data

US 2002/0062984 A1 May 30, 2002

(30) Foreign Application Priority Data

Nov. 21, 2000 (DE) ..... 100 57 657

(51) Int. Cl.[7] ..... H01B 7/00
(52) U.S. Cl. ..... 174/120 R; 174/120 C
(58) Field of Search ..... 174/110 R, 113 R, 174/120 R, 120 C; 428/304.4; 29/434

(56) References Cited

U.S. PATENT DOCUMENTS 5,002,359 A * 3/1991 Sayegh ..... 385/107
5,025,115 A * 6/1991 Sayegh et al. ..... 174/117 F
5,061,823 A * 10/1991 Carroll ..... 174/105 R
5,429,869 A * 7/1995 McGregor et al. ..... 428/364
5,560,986 A * 10/1996 Mortimer, Jr. ..... 428/308.4

* cited by examiner

*Primary Examiner*—William H. Mayo, III
(74) *Attorney, Agent, or Firm*—Birch, Stewart, Kolasch & Birch, LLP

(57) ABSTRACT

An electrical wire or cable has a metallic conductor surrounded by at least one layer of polyimide winding tape. Over the insulator is at least one layer of polytetrafluoroethylene winding tape having a planoconvex cross section. The outermost layer of the polyimide winding tape has a bond with the polytetrafluoroethylene winding tape. The resulting construction has a smooth surface that can be marked.

24 Claims, 2 Drawing Sheets

ELECTRICAL CABLE

This nonprovisional application claims priority under 35 U.S.C. §119(a) on Patent Application No. 100 57 657.5-34, filed in Germany on Nov. 21, 2000, the entire content of which is incorporated by reference.

FIELD OF THE INVENTION

An electrical wire has a metallic conductor enclosed by a sintered insulation containing one or more layers of an unsintered polytetrafluoroethylene-based winding tape that overlap in the edge regions, the winding tape having a planoconvex cross-section that is defined by a curved upper boundary line and a straight lower boundary line.

BACKGROUND OF THE INVENTION

The insulation of electrical cable or wire needs to conform to a number of requirements. These requirements include dielectric properties, mechanical strength, resistance to extremes in temperature, etc.

An electrical wire or cable known in the conventional art is typified by DE-PS 32 14 447 to Eilentropp, which is equivalent to U.S. Pat. No. 4,791,966. In Eilentropp, unsintered winding tape produces insulation with a specified cross-section. Sintering of the polytetrafluoroethylene subsequent to the winding process results in a smooth outer surface comparable to those obtained through an extrusion process. Similar to an extruded insulating covering, this insulation made from a winding tape provides resistance to mechanical forces that could lead to tearing of the insulation.

However, there are applications of wire and cable, for example in aircraft and satellite construction, which make new demands with respect to mechanical strength in combination with dielectric strength that the conventional art insulation is not able to easily satisfy. That is, the conventional art insulated cable fails to provide the desired compactness, electrical isolation and smooth outer surface combined with the high mechanical strength and dielectric strength required for the vigorous conditions associated with aerospace applications.

An additional disadvantage associated with the conventional art arises from the labeling of wires, for example, by stamping in of identifying information. This labeling can cause damage to the surface of the insulation. This surface damage, in interplay with dirt or dust particles, water or oils, forms lubricating films on the surface of the insulation. The lubricating films can easily lead to corona discharge during operation and thus ultimately to short circuits in the wiring area.

SUMMARY OF THE INVENTION

The invention, in part, pertains to an electrical wire or cable that overcomes the disadvantages of the conventional art and satisfies the demands for high mechanical strength and dielectric strength while retaining compactness of the insulation and provides a continuous, smooth outer surface.

The invention, in part, pertains to an electrical wire composed of a metallic conductor having at least one layer of polyimide winding tape wound around the metallic conductor, a sintered intermediate layer around the polyimide winding tape, and at least one layer of polytetrafluoroethylene winding tape around the sintered insulator. The polytetrafluoroethylene winding tape has a planoconvex cross section having a curved upper boundary and a straight lower boundary. The outermost layer of polyimide winding tape has a bond with the polytetrafluoroethylene winding tape. The polytetrafluoroethylene winding tape can be sintered. The metallic conductor can be copper or copper alloy that is bare, tinned, silver-plated or nickel-plated.

The invention, in part, pertains using a fluoropolymer is to bond the adjacent tape layers. The fluoropolymer can be either melt-processable or not melt-processable. The polytetrafluroethylene winding tape of the insulation comprises polytetrafluoroethylene modified with no more than 2% by weight fluoromonomers. The maximum thickness of the planoconvex winding tape is between about 10 and about 100 $\mu$m and a width of between 3 and 50 mm, preferably about 5 and 25 mm. The winding tape of polyimide can be coated on one or both sides with a fluoropolymer.

The invention, in part, pertains to a method manufacturing an electrical wire, which provides a metallic conductor, winds at least one layer of polyimide winding tape around the metallic conductor, forms a sintered intermediate layer around the polyimide winding tape, winds at least one layer of polytetrafluoroethylene winding tape around the sintered insulator, and bonds the outermost layer of the polyimide winding tape with the polytetrafluoroethylene winding tape. The method additionally sinters the polytetrafluoroethylene winding tape to produce a homogeneous sleeve with a smooth surface. The polytetrafluoroethylene winding tape has a planoconvex cross section having a curved upper boundary and a straight lower boundary.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention. The drawings illustrate embodiments of the invention and together with the description serve to explain the principles of the embodiments of the invention.

DETAILED DESCRIPTION

Advantages of the present invention will become more apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention improves the known cable or wire such that it satisfies the demands for high mechanical strength and dielectric strength while retaining compactness. The wire also provides a continuous, smooth outer surface.

Figure 1:
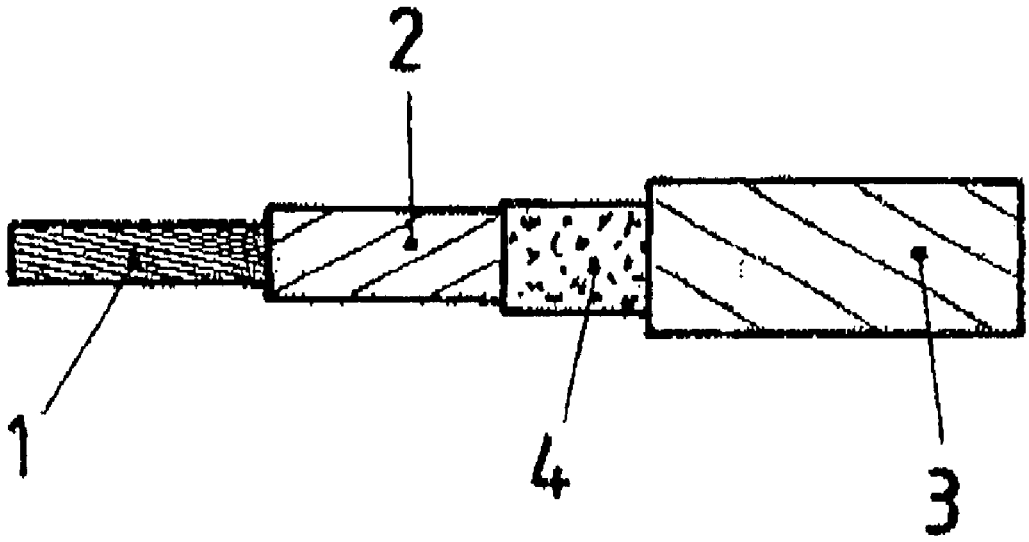
FIG. 1 shows an electrical cable according to a preferred embodiment of the invention.

An electrical cable of a preferred embodiment of the invention is shown in FIG. 1.

In FIG. 1, a metallic conductor 1 of the wire can be of solid design, but if preferably is a stranded conductor for increased flexibility of the wire. The metallic conductor 1 can be made of such materials as bare, tinned, silver-plated or nickel-plated copper or copper alloy wire or wires. Wrapped directly around the metallic conductor 1 are one or more layers of the polyimide tape forming a winding layer 2. An intermediate layer 4 (also called the insulator) is made of a fluoropolymer, for example tetrafluoroethylene/hexafluoropropylene copolymer (FEP) or polytetrafluoroethylene (PTFE). The intermediate layer 4 is initially applied as a powder and is subsequently sintered, and serves to make a strong bond between the winding layer 2 and the layer made of PTFE tape 3. Here (and also above), the term "polytetrafluoroethylene" includes tetrafluoroethylene polymers that are provided with modifying additives, but in such quantities that the polymer is not melt-processable, like PTFE itself.

It has proven advantageous, particularly with regard to simplifying the manufacturing process and the necessary minimizing of the outer dimensions of the wire, to use pre-backed polyimide-based tapes or films when forming the intermediate layer 4. Such pre-backed polyimide tapes are commercially available, an example being Du Pont's OASIS brand.

Figure 2:
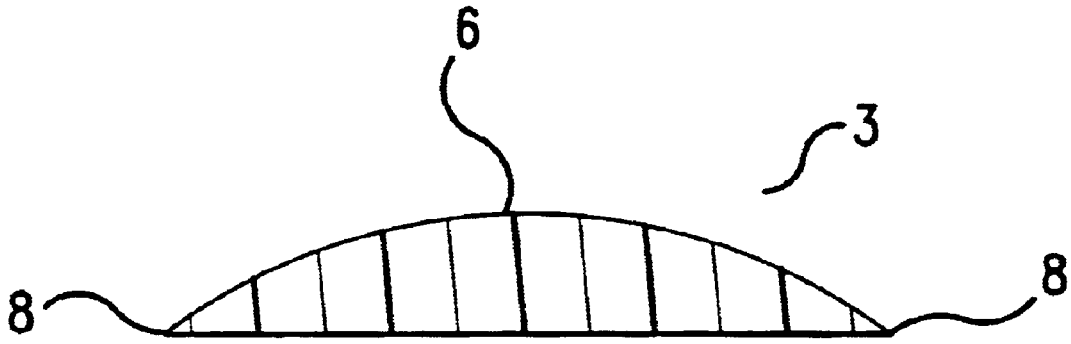
FIG. 2 shows a cross section of the polytetrafluoroethylene winding tape according to a preferred embodiment of the invention.

The polyimide tape comprising the winding layer 2 serves to improve the dielectric strength and the mechanical strength of the wire. The single-layered or multi-layered wrapping of the PTFE tape 3 with the special planoconvex cross-section ensures the high abrasion resistance, temperature resistance and arc resistance required for such wires. It is important for the selected wrappings that the tape edges overlap; this is particularly important for a continuous, smooth outer surface of the sleeve formed by the PTFE tape 3. This is because the use of an unsintered PTFE tape 3 with a planoconvex cross-sectional shape having a fatter middle region 6 and an edge region 8 that tapers to approach zero thickness, as shown in FIG. 2, for example. The overlap results in a compact, essentially homogeneous sleeve with a smooth surface after the winding process and the subsequent temperature treatment (sintering), due to the welding of the tape edges. Protruding tape edges that would be points of attack for outside mechanical forces are eliminated. Therefore, labeling, even stamping, of the surface can be accomplished without difficulty, so there is no fear of corona discharges or arcing during use in prevailing conditions such as aggressive media, moisture, dirt, etc.

If a backed polyimide tape is used in implementing the invention, this tape can also be coated on both sides to achieve a certain adhesion to the conductor. This adhesion can help make it easier to strip the insulation from the electrical conductor for the purpose of installing the wire.

Advantages of the invention arise from, in part, one or more layers winding tape made of polyimide forming the winding layer 2 being arranged between the electrical conductor 1 and the insulation 4, where the outermost layer of this winding tape that faces the insulation 4 is bonded to the winding layer of the PTFE tape 3 that faces the conductor 1. Such cables or wires satisfy even the most stringent requirements for mechanical strength, resistance to aggressive media, and dielectric strength.

In the invention, the metal conductor 1 and the insulation 4 is separated by one or more layers of polyimide winding tape or foil 2. The cable is covered by one or more winding layers of a PTFE-based tape 3 having a planoconvex cross-section. This results in the further advantage of an arc-resistant insulation with high corona resistance. This resistance is due to the continuous, smooth surface of the outermost layers of polytetrafluoroethylene-based tape and its ability to withstand external mechanical forces. Thus, the high wear resistance of the polytetrafluoroethylene prevents damage to the smooth, continuous surface, for example when the wires are pulled into cable conduits, when the wires are laid during manufacture of long cable harnesses such as are common in aircraft construction, or when the wires are routed around sheet-metal edges or corners, or the like.

An additional advantage of the invention pertains to labeling. The simple labeling of wires, for example by stamping in identifying information, can cause damage to the surface of the insulation. This damage will interact with one or a combination of dirt particles, dust particles, water or oils, to produce lubricating films on the surface of the insulation. This lubricating film promotes corona discharge during operation and thus ultimately to short circuits in the wire area.

The polytetrafluoroethylene component in a preferred embodiment of the invention thus provides a vital contribution to the arcing and corona resistance to the cables and wires. This advantage is enhanced by the polyimide winding tape that, when used in accordance with the invention, increases the dielectric strength and mechanical strength. Otherwise, the wire or cable would not by itself satisfy the requirements for arc and corona resistance in critical aerospace applications.

For this reason, in a preferred embodiment of the invention, one can also, increase the number of winding layers of the polyimide tape while keeping the outer dimensions of the wire remain the same. As a result, the dielectric strength increases, while reducing the number of polytetrafluoroethylene-based tape layers to the extent that this tape can be considered merely a protective covering to prevent damage caused by arcing or corona discharges.

Conversely, when low dielectric strength is required, the wall thickness of the insulation as a whole can be reduced, saving space and weight, which is a particular advantage of the wire when it is used for aircraft or satellite construction.

In a preferred embodiment of the invention, it is advantageous to bond the construction to produce a compact insulation by heat-sealing or gluing the adjacent tape layers. Also, temperature resistance of the wire is highly desirable, and it has proven advantageous to use fluoropolymers adjacent to the polyimide in the layer structure. A preferred fluoropolymer is polytetrafluoroethylene. Suitable fluoropolymers are those that are melt-processable, such as tetrafluoroethylene/hexafluoropropylene copolymer (FEP), perfluoroalkoxy polymer (PFA), and also tetrafluoroethylene perfluoroalkylvinyl ether copolymer (TFA/PFA), with the first of these being preferred. Fluoropolymers that are melt-processable are also suitable, such as polyvinylidene fluoride (PVDF) and ethylene-tetrafluoroethylene (ETFE), which can at times also be used to advantage.

The fluoropolymers can be extruded onto the outermost winding layer of the polyimide tape, but it is also possible to apply these fluoropolymer components to the winding tape itself beforehand, i.e., to use a polyimide tape backed with the fluoropolymer as an adhesive.

Another advantageous embodiment of the invention utilizes fluoropolymers that are not melt-processable as a bonding agent between the polyimide wrapping or tape forming the winding layer 2 and the wrapping made of PTFE tape 3. To this end, polytetrafluoroethylene itself, for example, or a polytetrafluoroethylene modified with no more than about 2% by weight fluoromonomers, is used powder form. This polymer powder, applied to the polyimide wrapping or to the polyimide tape itself as a backing, melts at the sintering temperature of the polytetrafluoroethylene winding tape and thus ensures a strong bond between the winding layers of the different polymer materials.

It is advantageous for the maximum thickness of the planoconvex PTFE tape 3, i.e., the thickness of the fatter middle section of the lenticular cross-section, to be between about 15 and about 100 μm when the thickness of the tape edge region is about 5 μm or less, i.e., tapering to 0. These dimensions demonstrate that the polytetrafluoroethylene winding layer covering the polyimide wrapping can, when necessary, be used merely as a protective covering. This yields advantages provided by both the material and the shape of the tape's cross-section, namely high resistance to abrasion and a compact, continuous, smooth outer surface. It is preferred that the planoconvex winding tape has a width between about 3 and 50 mm, most preferably between about 5 and 25 mm, depending on the diameter of the conductor.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

I claim:

1. An electrical cable, which comprises:

a metallic conductor;

at least one layer of polyimide winding tape wound around the metallic conductor; and at least one layer of polytetrafluoroethylene winding tape around the polyimide layer, the polytetrafluoroethylene winding tape having a planoconvex cross section having a curved upper boundary and a straight lower boundary, wherein the outermost layer of the polyimide winding tape has a bond with the polytetrafluoroethylene winding tape.

2. The electrical cable according to claim 1, wherein the bond is achieved by heat-sealing or gluing adjacent tape layers.

3. The electrical cable according to claim 2, wherein a fluoropolymer is used to bond the adjacent tape layers.

4. The electrical cable according to claim 3, wherein the fluoropolymer is melt-processable.

5. The electrical cable according to claim 3, wherein the fluoropolymer is not melt-processable.

6. The electrical cable according to claim 1, wherein the polytetrafluroethylene winding tape of the insulation comprises polytetrafluoroethylene modified with no more than 2% by weight fluoromonomers.

7. The electrical cable according to claim 1, wherein the maximum thickness of the planoconvex winding tape is between about 10 and 100 μm.

8. The electrical cable according to claim 1, wherein the width of the planoconvex winding tape is between 3 and 50 mm.

9. The electrical cable according to claim 1, wherein the width of the planoconvex winding tape is between 5 and 25 mm.

10. The electrical cable according to claim 1, wherein the polyimide winding tape is coated on one or both sides with a fluoropolymer.

11. The electrical cable according to claim 3, wherein the fluoropolymer is at least one selected from the group consisting of tetrafluoroethylene/hexafluoroethylene copolymer, perfluoroalkoxy polymer and tetrafluoroethylene perfluoroalkylvinyl ether copolymer.

12. The electrical cable according to claim 10, wherein the fluoropolymer is at least one selected from the group consisting of tetrafluoroethylene/hexafluoroethylene copolymer, perfluoroalkoxy polymer and tetrafluoroethylene perfluoroalkylvinyl ether copolymer.

13. The electrical cable according to claim 1, wherein the metallic conductor is solid or stranded.

14. The electrical cable according to claim 1, wherein the metallic conductor comprises copper or copper alloy.

15. The electrical cable according to claim 1, wherein the metallic conductor is bare, tinned, silver plated or nickel plated.

16. The electrical cable according to claim 1, wherein the polytetrafluoroethylene winding tape is sintered.

17. The electrical cable according to claim 1, wherein an innermost layer of the polyimide winding tape is adhered to an outer surface of the metallic conductor.

18. A method manufacturing an electrical cable, which comprises:

providing a metallic conductor;

winding at least one layer of polyimide winding tape around the metallic conductor;

winding at least one layer of polytetrafluoroethylene winding tape around the polyimide layer, the polytetrafluoroethylene winding tape having a planoconvex cross section having a curved upper boundary and a straight lower boundary; and bonding the outermost layer of the polyimide winding tape with the polytetrafluoroethylene winding tape.

19. The method of claim 18, wherein the bonding is performed by heat sealing or gluing.

20. The method of claim 18, further comprising sintering the polytetrafluoroethylene winding tape.

21. The method of claim 18, wherein the maximum thickness of the planoconvex cross section is between about 10 and 100 μm.

22. An electrical cable, comprising:

a metallic conductor;

at least one layer of polyimide winding tape wound around the metallic conductor; and at least one layer of polytetrafluoroethylene winding tape around the polyimide winding tape, the polytetrafluoroethylene winding tape having a planoconvex cross section having a curved upper boundary and a straight lower boundary.

23. An electrical cable, comprising:

a metallic conductor;

at least one layer of a non-conducting winding tape wound around the metallic conductor; and at least one layer of polytetrafluoroethylene winding tape being wound around the non-conducting winding tape, the polytetrafluoroethylene winding tape having a planoconvex cross section having a curved upper boundary and a straight lower boundary.

24. A method of manufacturing an electrical cable, comprising the following steps:

providing a metallic conductor;

winding at least one layer of polyimide winding tape around the metallic conductor; and winding at least one layer of polytetrafluoroethylene winding tape around the polyimide winding tape, the polytetrafluoroethylene winding tape having a planoconvex cross section having a curved upper boundary and a straight lower boundary.

* * * * *